US007894741B2

(12) United States Patent
Shinkawa et al.

(10) Patent No.: US 7,894,741 B2
(45) Date of Patent: Feb. 22, 2011

(54) CLEANING DEVICE WHICH CLEANS A CONTACT CHARGING MEMBER THAT IS DISPOSED IN CONTACT WITH AN IMAGE BEARING MEMBER

(75) Inventors: Kohji Shinkawa, Nara (JP); Tohru Sakuwa, Nara (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 495 days.

(21) Appl. No.: 12/068,938

(22) Filed: Feb. 13, 2008

(65) Prior Publication Data

US 2008/0292354 A1 Nov. 27, 2008

(30) Foreign Application Priority Data

Feb. 16, 2007 (JP) ..... 2007-037171

(51) Int. Cl.
*G03G 15/02* (2006.01)

(52) U.S. Cl. ..... 399/100

(58) Field of Classification Search ..... 399/100
See application file for complete search history.

(56) References Cited

U.S. PATENT DOCUMENTS

| | | | | |
|---|---|---|---|---|
| 5,678,136 | A * | 10/1997 | Watanabe et al. | 399/100 |
| 5,978,616 | A * | 11/1999 | Shin | 399/50 |
| 6,701,105 | B2 | 3/2004 | Funabashi | |
| 6,807,390 | B2 | 10/2004 | Suda et al. | |
| 6,842,594 | B2 * | 1/2005 | Frankel | 399/89 |
| 7,515,846 | B2 * | 4/2009 | Miyaji | 399/100 |
| 2003/0194249 | A1 * | 10/2003 | Kawamura | 399/100 |
| 2005/0169668 | A1 | 8/2005 | Koichi et al. | |
| 2008/0124117 | A1 * | 5/2008 | Muraishi et al. | 399/100 |
| 2008/0181655 | A1 * | 7/2008 | Sakagawa et al. | 399/100 |
| 2009/0116863 | A1 | 5/2009 | Koichi et al. | |

FOREIGN PATENT DOCUMENTS

| | | | |
|---|---|---|---|
| JP | 3-130787 | A | 6/1991 |
| JP | 8-254878 | A | 10/1996 |
| JP | 2002-214997 | A | 7/2002 |
| JP | 2003-66807 | * | 3/2003 |
| JP | 2004-004749 | * | 1/2004 |
| JP | 2005-181864 | * | 7/2005 |
| JP | 2007-33816 | A | 2/2007 |

* cited by examiner

*Primary Examiner*—David M Gray
*Assistant Examiner*—G. M. Hyder
(74) *Attorney, Agent, or Firm*—Birch, Stewart, Kolasch & Birch, LLP

(57) ABSTRACT

A cleaning device 70 includes: contact and release system 63 which switches a position of a cleaning roller 62 between a position where the cleaning roller 62 is in contact with a charging roller 61 and a position where the cleaning roller 62 is separated from the charging roller 61; and a voltage selecting section 71 which switches a voltage to be applied to the charging roller 61 from a DC voltage to an AC voltage during the rotation of a photoreceptor 11. The contact and release system 63 brings the cleaning roller 62 into contact with the charging roller 61 at the application of the AC voltage to the charging roller 61. This makes it possible to enhance performance on cleaning of the charging roller.

14 Claims, 7 Drawing Sheets

10Y,10M,10C,10B

CLEANING DEVICE WHICH CLEANS A CONTACT CHARGING MEMBER THAT IS DISPOSED IN CONTACT WITH AN IMAGE BEARING MEMBER

This Nonprovisional application claims priority under U.S.C. §119(a) on Patent Application No. 37171/2007 filed in Japan on Feb. 16, 2007, the entire contents of which are hereby incorporated by reference.

FIELD OF THE INVENTION

The present invention relates to (i) a cleaning device which cleans a charging device that charges an image bearing member, and (ii) an image forming apparatus including the cleaning device.

BACKGROUND OF THE INVENTION

In the past, a charging device for charging the surface of a photoreceptor (image bearing member) in an electrophotographic image forming apparatus was a corona charger which generates a large amount of ozone. In recent years, however, a contact roller charger which generates a small amount of ozone has been used due to environmental concerns. In addition, a high-speed apparatus (image forming apparatus capable of high-speed processing) including the contact roller charger has been developed.

In the electrophotographic image forming apparatus, part of a toner of a toner image formed on the photoreceptor is transferred to an intermediate transfer body or a transfer medium, such as a transfer sheet, in the transfer process, while the rest of the toner remains on the surface of the photoreceptor even after the transfer process. The remaining toner left on the photoreceptor results in a low image quality in the subsequent image formation. In order to remove the residual toner on the photoreceptor, a cleaning device provided with a cleaning blade that is brought into contact with the photoreceptor is frequently used. In the transfer process, a rate of transfer of a toner to the transfer medium is approximately 95% at the highest. Therefore, some of the toner remains on a photoreceptor drum (such toner is referred to as "residual toner"). The residual toner is basically all cleaned in the cleaning process that follows the transfer process.

However, as described above, in a normal cleaning device of the electrophotographic image forming apparatus is adopted a blade cleaning system that realizes a simple structure and easy control. During the cleaning in the blade cleaning system, a certain degree of vibration occurs in the photoreceptor and the cleaning blade at the micro level (slip-stick phenomenon). Because of this, the residual toner can pass through the cleaning blade at some timing.

Here, in a case where the contact roller charger is used as a charging device, incomplete cleaning with a cleaning blade causes the following event. That is, toner and silica additive of small-diameter particles passing through the cleaning blade contaminate the charging roller. As a result of this, phenomena such as charging performance deterioration and uneven charging occur. These phenomena are more likely to occur especially in high-speed apparatuses.

As a solution for such a problem, there has been studied a method in which a cleaning section such as a sponge roller or a cleaning brush is brought into contact with a charging roller to perform cleaning. For example, Patent Document 1 (Japanese Unexamined Patent Publication No. 66807/2003 (Tokukai 2003-66807; published on Mar. 5, 2003) discloses a transferring device and a charging device which includes a cleaning member that is formed with a melamine resin foam at a part where it comes into contact with an object to be cleaned. Further, for example, Patent Document 2 (Japanese Unexamined Patent Publication No. 4749/2004 (Tokukai 2004-4749; published on Jan. 8, 2004) discloses an image forming apparatus having a cleaning section which comes into contact with a charging member to remove foreign substances adhered to the surface of the charging member.

SUMMARY OF THE INVENTION

However, the cleaning section for the charging roller builds up the dirt such as toner. Therefore, the problems of cleaning performance deterioration and charging performance deterioration accompanied with the cleaning performance deterioration are not sufficiently solved.

The present invention has been attained in view of the above problems. An object of the present invention is to provide a cleaning device, an image forming apparatus, a method for controlling an image forming apparatus, a control program, and a computer-readable storage medium, all of which prevents toner from adhering to a charging roller and enhances cleaning performance.

In order to solve the above problems, a cleaning device according to the present invention is a cleaning device which cleans a contact charging member that is disposed in contact with an image bearing member and charges the image bearing member with a DC voltage applied to the contact charging member, the cleaning device including: a cleaning member disposed in contact with the contact charging member; and a voltage selecting section which switches a voltage to be applied to the contact charging member from a DC voltage to an AC voltage and then applies the AC voltage thereto during rotation of the image bearing member.

According to the above arrangement, a DC voltage which is applied to the contact charging member at the charging of the image bearing member is switched to an AC voltage so that the contact charging member is charged with the AC voltage. Application of the AC voltage causes a charged substance in the order of micrometer, such as toner, adhered to the contact charging member to be returned to the image bearing member. An additive or other substance in the order of nano-micrometer, which has extremely strong adherence, can be removed by having it mechanically adhered to the cleaning member in contact with the contact charging member. In this manner, it is possible to prevent a toner from adhering to the contact charging member and enhances performance on cleaning of the contact charging member.

As described above, the substance that contaminates the contact charging member is removed by having it return to the image bearing member and having it adhere to the cleaning member. This makes it possible to properly clean the contact charging member and decrease contamination of the cleaning member. Therefore, it is possible to expand lives of the contact charging member and the cleaning member.

The enhancement in performance on cleaning of the contact charging member makes it possible to improve charging performance of the contact charging member, and realize fine charging of the contact charging member all the time.

Additional objects, features, and strengths of the present invention will be made clear by the description below. Further, the advantages of the present invention will be evident from the following explanation in reference to the drawings.

DESCRIPTION OF THE EMBODIMENTS

Figure 2:
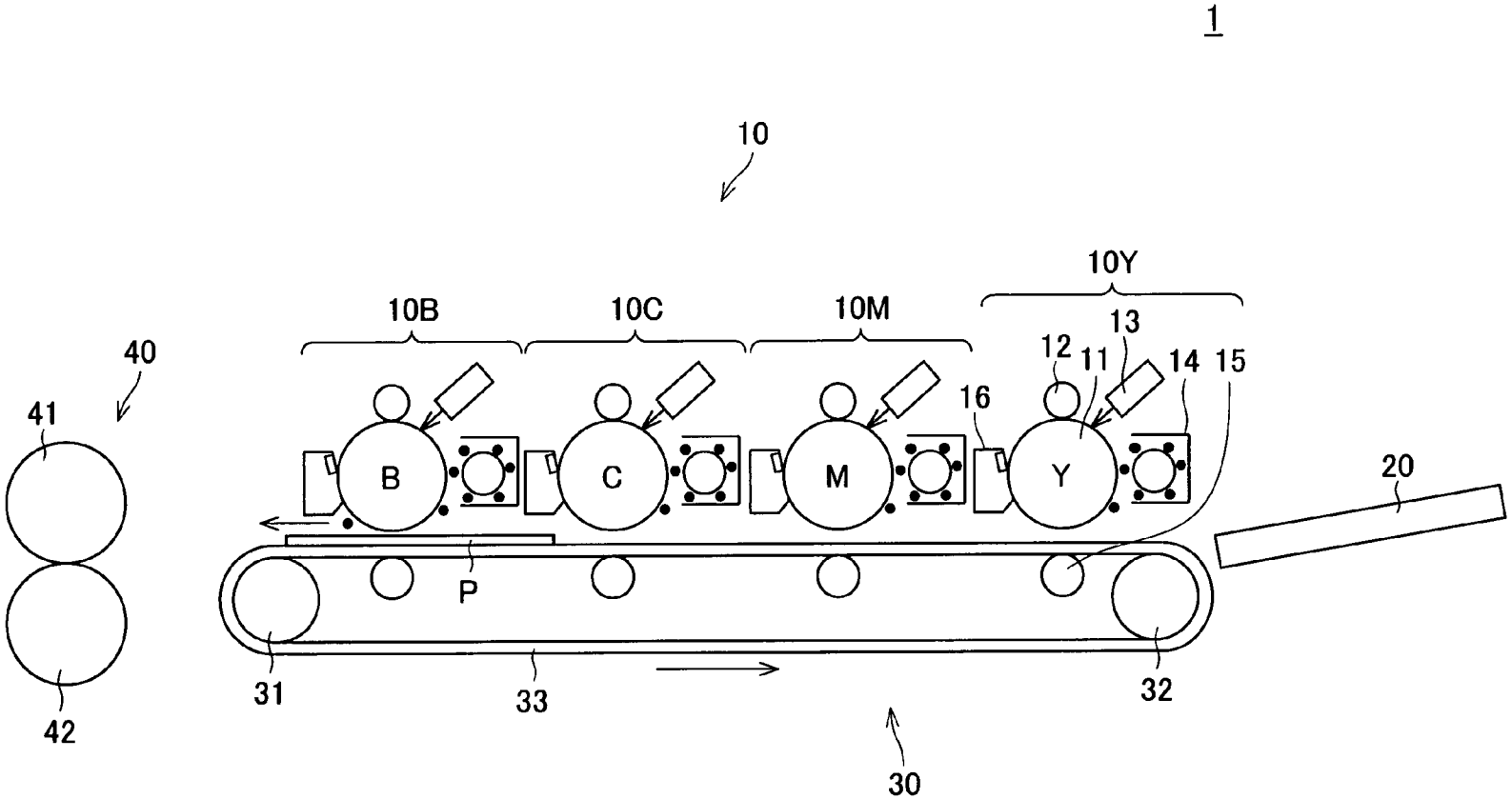
FIG. 2 is an explanatory view schematically illustrating the image forming apparatus according to an embodiment of the present invention.

The following will describe an embodiment of the present invention. First of all, an image forming apparatus of the present embodiment which is provided with a cleaning device of the present embodiment is described. FIG. 2 is an explanatory view schematically illustrating the configuration of an image forming apparatus 1 of the present embodiment. The image forming apparatus 1 is an electrophotographic color image forming apparatus. The image forming apparatus 1 forms multicolor or monochrome images on recording paper (transfer medium) in accordance with image data externally transmitted through a network or image data read by an image reading apparatus (not shown).

As illustrated in FIG. 2, the image forming apparatus 1 includes a visible image forming unit 10, a paper feed tray 20, a recording paper transporting section 30, and a fixing device 40. In the present embodiment, an image (toner image) developed by the visible image forming unit 10 is directly transferred on recording paper P. However, the image may be transferred to an intermediate transfer medium such as an intermediate transfer belt.

In the visible image forming unit 10, four visible image forming units 10Y, 10M, 10C, 10B are arranged respectively corresponding to yellow (Y), magenta (M), cyan (C), and black (B). More specifically, the visible image forming unit 10 is realized by four visible image forming units 10Y, 10M, 10C, and 10B. The visible image forming unit 10Y performs image formation by using a yellow (Y) toner. The visible image forming unit 10M performs image formation by using a magenta (M) toner. The visible image forming unit 10C performs image formation by using a cyan (C) toner. The visible image forming unit 10B performs image formation by using a black (B) toner. The four visible image forming units 10Y, 10M, 10C, and 10B are disposed along a transfer pathway through which recording paper is transported from the paper feed tray 20 to the fixing device 40. During the transport, the toners of four colors are transferred onto the recording paper P being transported in such a manner so as to be superimposed thereon one after another.

Figure 1:
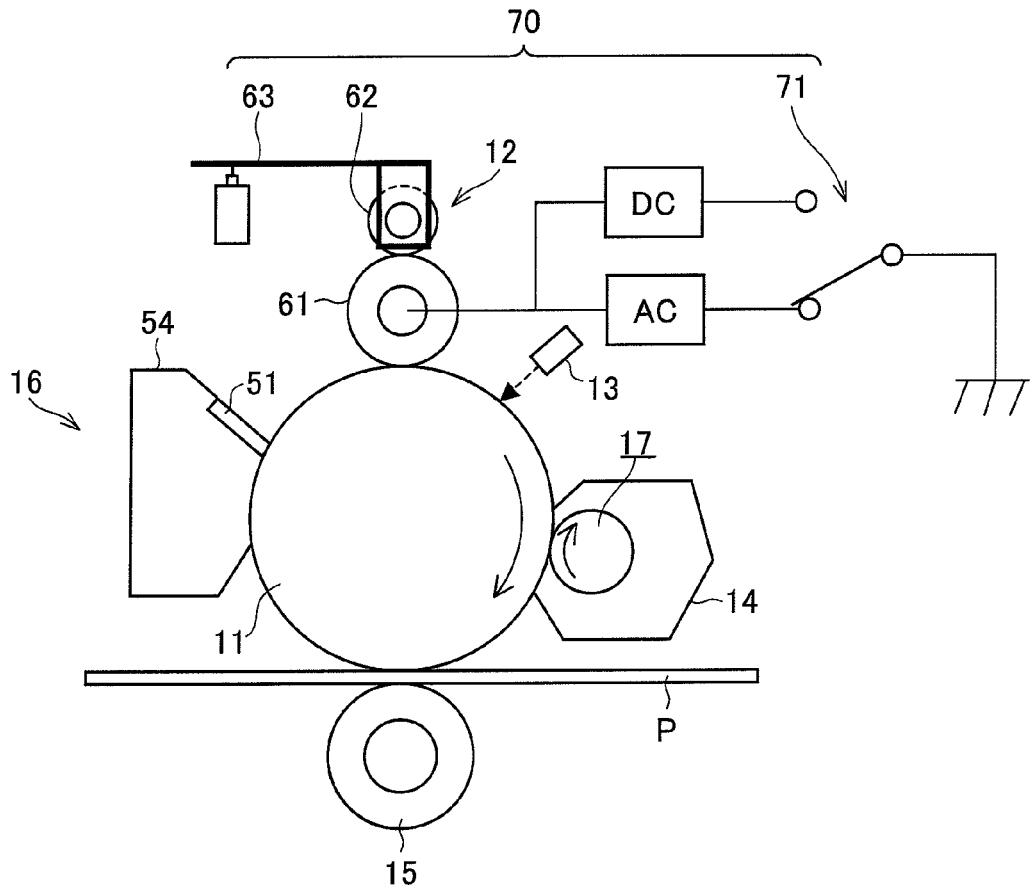
FIG. 1 is a cross-sectional view illustrating the configuration of a visible image forming unit which is provided in an image forming apparatus according to an embodiment of the present invention.

FIG. 1 is a cross-sectional view illustrating the structure of each of the visible image forming units 10Y, 10M, 10C, and 10B. As illustrated in FIG. 1, the visible image forming units 10Y, 10M, 10C, and 10B have substantially the same structure. That is, each of the visible image forming units 10Y, 10M, 10C, and 10B includes a photoreceptor (image bearing member) 11, a charging device 12, a laser beam emitting section 13, a development device 14, a transfer roller 15, and a cleaner unit 16.

The charging device 12 evenly charges the surface of the photoreceptor 11 at a predetermined potential. In the present embodiment, the charging device 12 is a contact-type charging device in which a charging roller 61 brings into contact with the photoreceptor 11 so as to charge the surface of the photoreceptor 11. The charging device 12 is provided with a cleaning device 70 of the present embodiment. Details of the charging device 12 will be described later.

The laser beam emitting section 13 performs exposures of the surface of the photoreceptor 11 having been charged by the charging device 12 and forms an electrostatic latent image on the surface of the photoreceptor 11 in accordance with the image data.

The development device 14 develops, with a toner, the electrostatic latent image formed on the photoreceptor 11 to form a toner image.

The transfer roller 15 is subjected to application of a bias voltage which is opposite in polarity to toner, thereby transferring the toner image formed on the surface of the photoreceptor 11 onto the recording paper P transported by the recording paper transporting section 30.

The cleaner unit 16 removes and collects residual toner remaining on the surface of the photoreceptor 11 after the transfer process made by the transfer roller 15. As illustrated in FIG. 1, the cleaner unit 16 includes a case 54 and a cleaning blade 51.

The cleaning blade 51 collects residual toner remaining on the surface of the photoreceptor 11, and is realized by a long rubber member whose long side extends in an axial direction of the photoreceptor 11. The rubber member used for the cleaning blade 51 can be made of, for example, urethane rubber, silicone rubber, chloroprene rubber, or butadiene rubber. The cleaning blade 51 is disposed in such a manner that one of the long side edges is on the downstream side in the rotational direction of the photoreceptor 11 in an opening that is provided in the case 54, while the other long side edge is in contact with the surface of the photoreceptor 11. With this arrangement, the cleaning blade 51 at its part in contact with the photoreceptor 11 blocks the residual toner remaining on the surface of the photoreceptor 11 after the transfer of the toner image, and scrapes the residual toner off by stick-slip operation. The stick-slip operation is repetitive movement of (a) an operation in which the part of the cleaning blade 51 in contact with the photoreceptor 11 moves in the rotational direction of the photoreceptor 11 in accordance with the movement of the surface of the photoreceptor 11; and (b) an operation in which the cleaning blade 51 returns to its original position by its own elastic force. In short, the stick-slip operation is the operation in which the edge of the cleaning blade 51 slides back and forth on the surface of the photoreceptor 11.

In order to prevent the photoreceptor 11 from being wore out by the cleaning blade 51, a section for applying a lubricant to the photoreceptor 11 may be provided.

With the above arrangement, each of the visible image forming units 10Y, 10M, 10C, and 10B performs the following process. That is, the charging device 12 charges the surface of the photoreceptor 11, the thus charged surface of the photoreceptor 11 is exposed to light by the laser beam emitting section 13 to form an electrostatic latent image, the electrostatic latent image is developed by the development device 14, and a toner image obtained after the development is transferred onto the recording paper by the transfer roller 15. The toner image remaining on the surface of the photoreceptor 11 after the transfer process is removed and collected by the cleaner unit 16. Then, transfers of the toner images onto the recording paper P are successively performed by the visible image forming units 10Y, 10M, 10C, and 10B of four colors, so that the toner images of the four colors are transferred onto the recording paper P in such a manner so as to be superimposed thereon one after another.

The recording paper transporting section 30 is constituted of a drive roller 31, an idling roller 32, and a transport belt 33. The recording paper transporting section 30 transports the recording paper so that each of the visible image forming units transfers the toner image onto the recording paper P. The transport belt 33, which is an endless belt, is set over the drive roller 31 and the idling roller 32. The transport belt 33 is rotated by rotation of the drive roller 31 at a predetermined circumferential speed. The transport belt 33, which is charged at a predetermined potential on its outer surface, transports the recording paper P while having the recording paper P electrostatically adsorbed to the transport belt 33.

The recording paper P is transported by the recording paper transporting section 30 and has the toner image (unfixed toner image) transferred thereon while passing through the visible image forming units 10Y, 10M, 10C, and 10B. Thereafter, the recording paper P is separated from the transport belt 33 by a curvature of the drive roller 31 and then transported to the fixing device 40. The fixing device 40 applies suitable heat and pressure to the recording paper P to fuse the toner transferred on the recording paper P and fix it on the recording paper P. Then, the resulting recording paper P is dropped into an output tray (not shown). The arrangement of the fixing device 40 is not particularly limited. The fixing device 40 can include a heating roller 41 and a pressure roller 42, for example, so that the recording paper P is transported while being sandwiched between the heating roller 41 and the pressure roller 42.

Note that the components provided in the image forming apparatus 1 operate under control of a main control section (mother board or computer, not shown).

Figure 3:
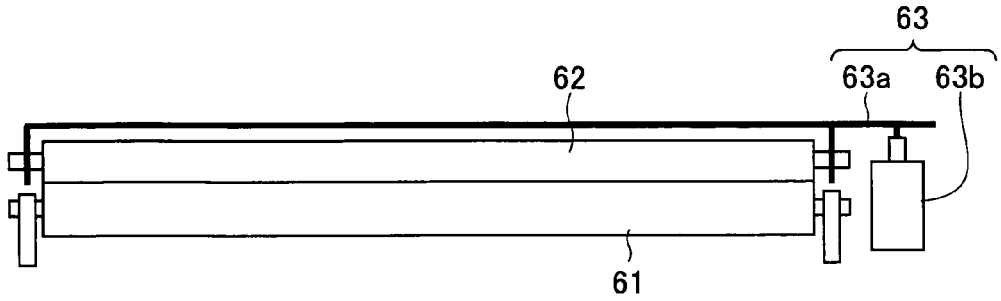
FIGS. 3(*a*) through 3(*c*) are views illustrating the structure of a charging device which is provided in a cleaning device according to an embodiment of the present invention.
Figure 3:
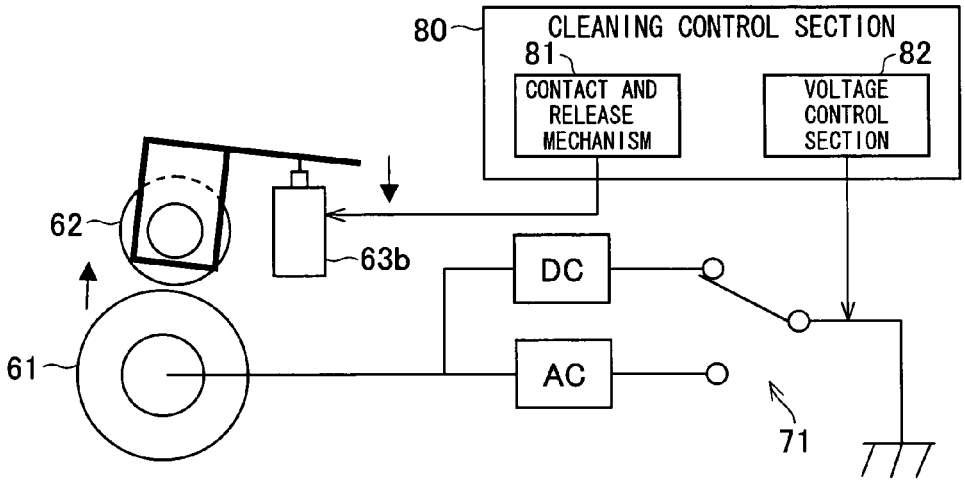
Figure 3:
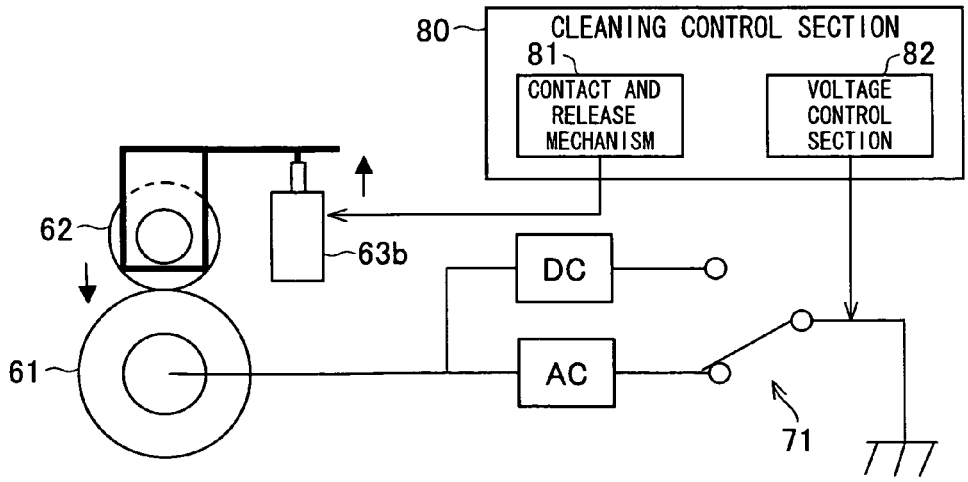

Next, the structure of the charging device 12 is described. As illustrated in FIGS. 3(*a*) and 3(*b*), the charging device 12 includes a charging roller (contact charging member) 61, a cleaning roller (cleaning member) 62, and a contact and release system (contact and release section) 63.

The length of the charging roller 61 is almost equal to the length of the photoreceptor 11 in its axial direction. The charging roller 61 is disposed in contact with the surface of the photoreceptor 11 in such a manner that an axis of the charging roller 61 is parallel to an axis of the photoreceptor 11. A DC voltage from a high-voltage power source is fed through the charging roller 61, which enables the charging roller 61 to evenly charge the surface of the photoreceptor 11. Note that the charging roller 61 is rotated by the photoreceptor 11.

The charging roller 61 has an electrically conductive support as a base, an elastic layer, and a resistance layer. The elastic layer is formed on an outer surface of the electrically conductive support, and the resistance layer is formed on the elastic layer. In the present embodiment, the charging roller 61 has an external diameter of 14ϕ, which is not the only possibility. The electrically conductive support can be a round bar made from metal such as iron, copper, stainless steel, aluminum, or nickel, for example. The electrically conductive support may be plated on its metallic surface for rust resistance and scratch resistance, to such a degree that conductivity of the electrically conductive support is not impaired.

The elastic layer has proper conductivity and elasticity to feed power to the photoreceptor 11 as an object to be charged and ensure excellently uniform close contact of the charging roller 61 with respect to the photoreceptor 11. More specifically, the elastic layer may be a product obtained by appropriately mixing an electron conducting agent having an electron-conducting mechanism, a conducting agent having an ion-conducting mechanism, etc. into a natural rubber, a synthetic rubber or an elastic material. Examples of the synthetic rubber includes ethylene-propylene rubber (EPDM), styrene-butadiene rubber (SBR), silicone rubber, urethane rubber, epichlorohydrin rubber, isoprene rubber (IR), butadiene rubber (BR), nitrile-butadiene rubber (NBR), and chloroprene rubber (CR). Examples of the elastic material include polyamide resin, polyurethane resin, and silicone resin. Examples of the electron conducting agent having an electron-conducting mechanism include carbon black, graphite, and conductive metal oxide. Examples of the conducting agent having an ion-conducting mechanism include alkali metal salt and quaternary ammonium salt. To ensure uniform close contact of the charging roller 61 with respect to the photoreceptor 11, the elastic layer is preferably grounded so that its midsection in the axial direction of the charging roller 61 is the thickest and the elastic layer taper down from the midsection toward the both ends (so-called crown shape).

The resistance layer is formed at a position adjoining the elastic layer, and hence it is provided in order to prevent a softening oil, a plasticizer or the like contained in the elastic layer, from bleeding out to the surface of the charging roller 61, and to adjust electrical resistance of the whole charging roller 61. The resistance layer is made from material having conducting properties or semiconducting properties. The material having conducting properties or semiconducting properties is obtained by appropriately mixing a conducting agent having an electron-conducting mechanism (e.g. conductive carbon, graphite, conductive metal oxide, and copper, aluminum, nickel, and iron powders) and a conducting agent having an ion-conducting mechanism (e.g. alkali metal salts and ammonium salts) into a material such as epichlorohydrin rubber, NBR, polyolefin-based thermoplastic elastomer, urethane-based thermoplastic elastomer, polystyrene-based thermoplastic elastomer, fluorine rubber-based thermoplastic elastomer, polyester-based thermoplastic elastomer, polyamide-based thermoplastic elastomer, polybutadiene-based thermoplastic elastomer, ethylene-vinyl acetate-based thermoplastic elastomer, polyvinyl chloride-based thermoplastic elastomer, chlorinated polyethylene-based thermoplastic elastomer. Any of these materials may be used alone, may be a mixture of two or more types, or may form a copolymer. In this case, in order to attain the desired electrical resistance, such various conducting agents may be used in combination of two or more types. However, taking account of environmental variations and contamination of the photoreceptor 11, the conducting agents having an electron-conducting mechanism are preferably used.

In applying a potential to the surface of the photoreceptor 11, a DC voltage is applied to the charging roller 61. In cleaning the charging roller 61, an AC voltage is applied thereto. Switching between the DC voltage and the AC voltage is performed by a voltage selecting section 71. The switching operation will be described later.

Figure 6:
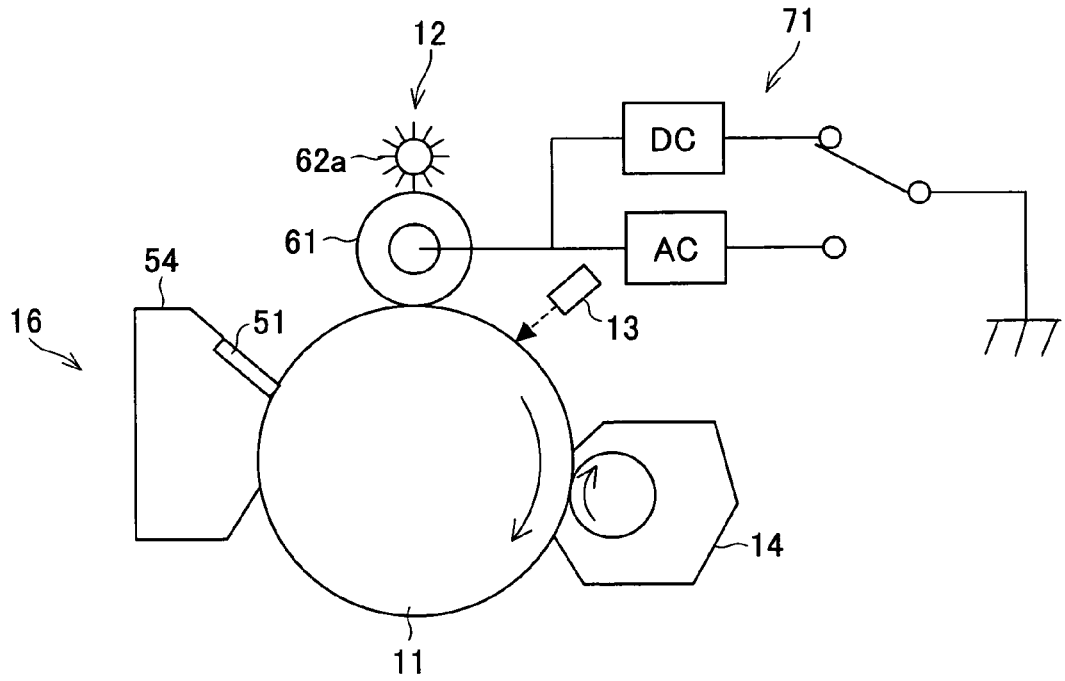
FIG. 6 is a view illustrating another example of a cleaning member which is provided in the cleaning device according to an embodiment of the present invention.
Figure 7:
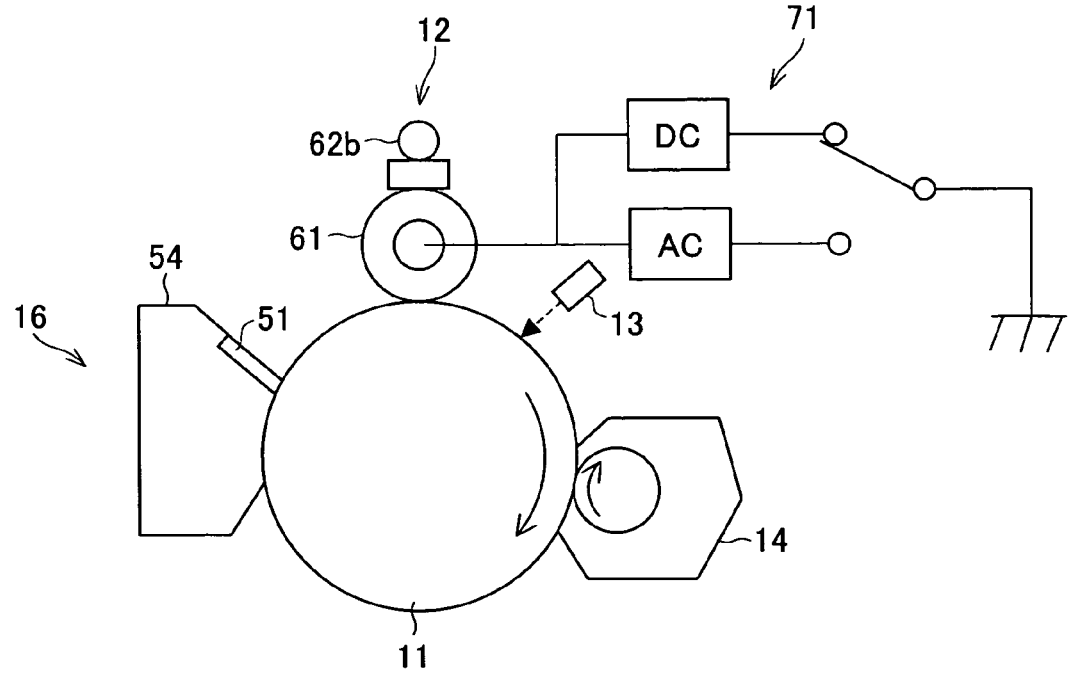
FIG. 7 is a view illustrating still another example of a cleaning member which is provided in the cleaning device according to an embodiment of the present invention.

The cleaning roller 62, which is disposed in contact with the surface of the charging roller 61, removes residual toner, paper in powder form, and others adhered to the surface of the charging roller 61. The cleaning roller 62 may be made from resin such as polyethylene resin, polyester resin, polypropylene resin, polyamide resin, polyurethane resin, and epoxy resin, or organic rubber such as IR, NBR, FPDM, and polyurethane rubber. The cleaning roller 62 may be solid or a foam. However, the cleaning roller 62 is preferably foam. In the present embodiment, the cleaning roller 62 is constituted of a SUS304 shaft having an external diameter of ϕ12 and a shaft diameter of ϕ8 and made from urethane foam having density of 30 ($Kg/m^3$), Asker-C hardness of 10 degrees, and cell diameter of 50 μm. However, these numerical values are not the only possibility. In the present embodiment, the cleaning roller 62 is used as a cleaning member. However, this is not the only possibility. For example, as illustrated in FIG. 6, the surface of the charging roller 61 may be cleaned by using a cleaning brush 62*a*. The cleaning brush 62*a* may be made from nylon with carbon black dispersed therein, acrylic resin, polyester resin, or the like. Furthermore, the cleaning member may take any shape other than roller shape. That is, the cleaning member may be anything if it can remove a contaminant and the like adhered to the surface of the charging roller 61. For example, the cleaning member may be a cleaning member 62*b* that is brought into contact with the surface of the charging roller 61, as illustrated in FIG. 7. The cleaning member 62*b* may be made from, for example, organic rubber such as IR, NBR, FPDM, and polyurethane, nonwoven cloth, or the like. When the charging roller 61 is ϕ14 in diameter and 320 mm in length, the size of the cleaning member 62*b* may be, for example, 10 mm wide×320 mm long×10 mm high.

The contact and release system 63 switches the position of the cleaning roller 62 between a position where the cleaning roller 62 is in contact with the charging roller 61 and a position where the cleaning roller 62 is separated from the charging roller 61. As illustrated in FIGS. 3(*a*) through 3(*c*), the contact and release system 63 includes a cleaning roller support 63*a* and an actuator realized by a solenoid 63*b*. As illustrated in FIG. 3(*a*), the cleaning roller support 63*a* is fixed at both ends of a support shaft of the cleaning roller 62. The solenoid 63*b* is arranged capable of lifting the cleaning roller support 63*a* fixed on the support shaft of the cleaning roller 62. With this arrangement, the position of the cleaning roller 62 is switched between the position where the cleaning roller 62 is in contact with the charging roller 61 and the position where the cleaning roller 62 is separated from the charging roller 61. More specifically, as illustrated in FIG. 3(*b*), when the solenoid 63*b* is ON, the cleaning roller 62 is separated from the charging roller 61. On the other hand, as illustrated in FIG. 3(*c*), when the solenoid 63*b* is OFF, the cleaning roller 62 comes into contact with the charging roller 61. The contact and release of the cleaning roller 62 is controlled by a contact and release mechanism 81 of a cleaning control section 80 that controls all aspects of cleaning of the charging roller. The arrangement of the contact and release system 63 is not limited to the above arrangement, and may be anything if the position of the cleaning roller 62 is changed between the position where the cleaning roller 62 is in contact with the charging roller 61 and the position where the cleaning roller 62 is separated from the charging roller 61.

Now, the residual toner is described. Residual materials remain on the photoreceptor 11 after the transferring process. The residual materials contain non-transferred toner (toner including small-diameter particles and uncharged toner) and an external toner additive (silica, magnetite, etc.). Particle diameter of silica used as an external additive is generally 1 to 2 orders of magnitude less than that of toner for the purpose of securing toner flowability. Basically, the residual materials are removed by the cleaning blade 51. However, a microtoner and an external additive having passed through the cleaning blade 51 are adsorbed by the charging roller 61 that is in contact with the photoreceptor 11. As an operating time increases, a large amount of toner having passed is adhered to the charging roller 61. This results in the occurrence of poor charging and uneven charging.

In view of this, the charging device 12 of the present embodiment is arranged such that the charging roller 61 is alternately subjected to application of a DC voltage for the application of a potential to the surface of the photoreceptor 11 and subjected to application of an AC voltage for the return of a toner adhered to the charging roller 61 to the photoreceptor 11. The voltage selection is performed by the voltage selecting section 71 that is realized by a switch, as illustrated in FIGS. 3(*b*) and 3(*c*). The voltage selection is under control of the voltage control section 82. In the present embodiment, the cleaning device 70 includes the cleaning roller 62, the contact and release system 63, and the voltage selecting section 71.

Next, the cleaning of the charging roller 61 is described with reference to FIGS. 4(*a*) and 4(*b*). Note that the present embodiment assumes that the toner is negatively charged. However, the present invention is not limited to this.

Figure 4:
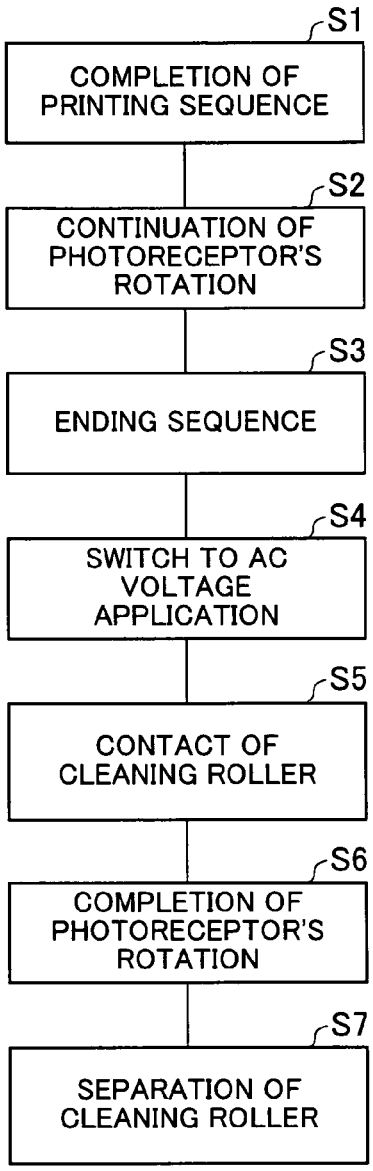
FIGS. 4(*a*) and 4(*b*) are views illustrating the flow of a process in which the cleaning device according to an embodiment of the present invention performs cleaning.
Figure 4:
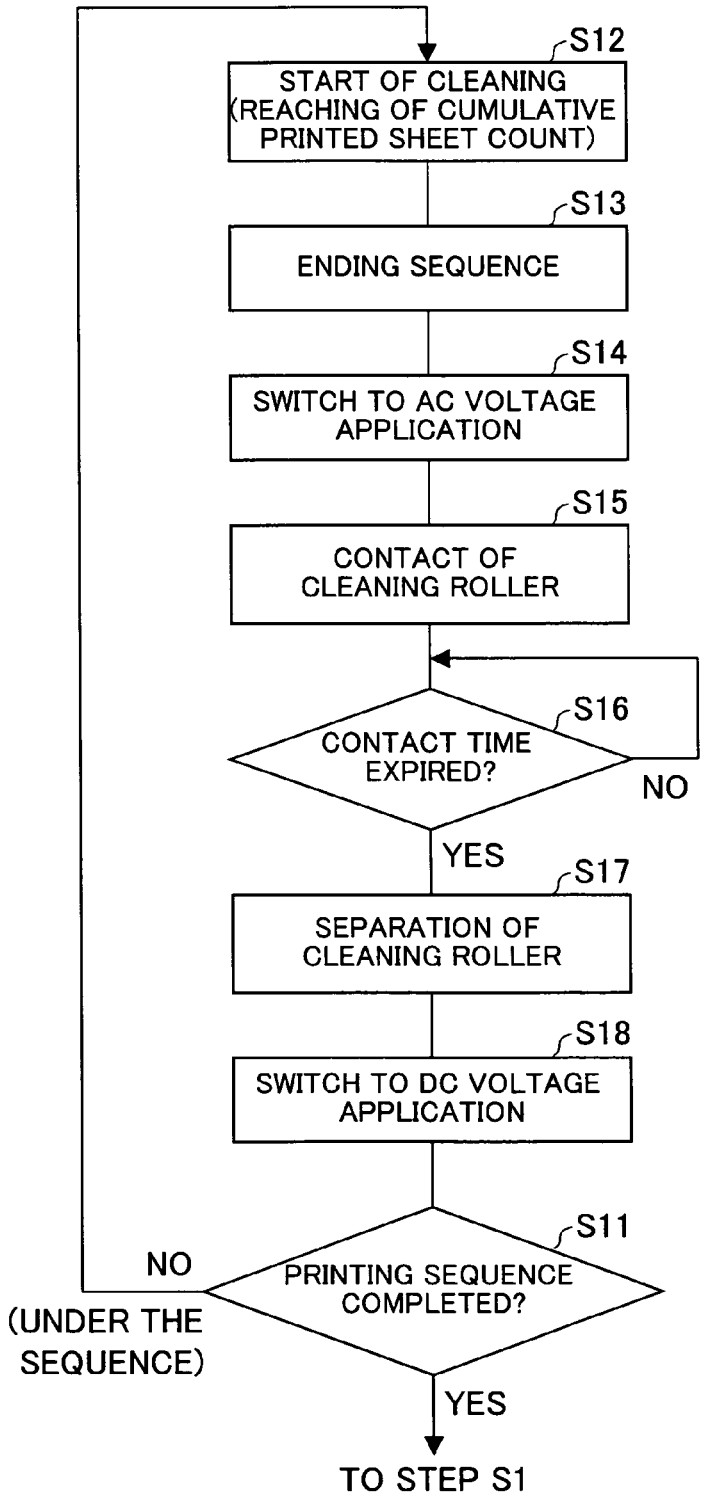

FIG. 4(*a*) is a flowchart of a cleaning process performed after a printing process is completed. At the point in time when a printing sequence is completed (S1), the photoreceptor continues rotating (S2). Then, the procedure enters an ending sequence (S3). At the point in time when a potential applied to the surface of the rotating photoreceptor 11 becomes nearly zero, a voltage to be applied to the charging roller 61 is switched from the DC voltage to the AC voltage by the voltage selecting section 71 (S4). The applied AC voltage is controlled so that its peak is lower than a discharge start voltage between the charging roller 61 and the photoreceptor 11. Then, the contact and release system 63 brings the cleaning roller 62 into contact with the charging roller 61 (S5). Note that either the step S4 or the step S5 may come first, or the steps S4 and S5 may be performed at the same time. The order in which the steps S4 and S5 are performed does not matter. When the AC voltage is applied to the charging roller 61, the toner adhered to the charging roller 61 returns to the photoreceptor 11. This is because the toner is charged to a moderate degree, the toner and the charging roller 61 electrically repel each other due to charges held by the toner and a voltage opposite in polarity, or alternating electric field caused by the AC voltage application weakens mechanical adherence of the toner to the charging roller. Further, the external additive including silica of small-diameter particles automatically moves to the cleaning roller 62 that is in contact with the charging roller 61. As a result of this, the charging roller 61 is always kept clean. Accordingly, no poor charging and uneven charging occurs.

When the cleaning of the charging roller 61 is completed, the rotation of the photoreceptor 11 is completed (S6), and then the cleaning roller 62 is separated from the charging roller 61 (S7). The cleaning device 70 may be controlled to determine that the cleaning of the charging roller 61 has been completed, for example, when a time during which the cleaning roller 62 is in contact with the charging roller 61 lapses a time for one turn of the charging roller 61. In order to ensure the cleaning, the contact time is preferably longer than the time for one turn of the charging roller 61.

Figure 5:
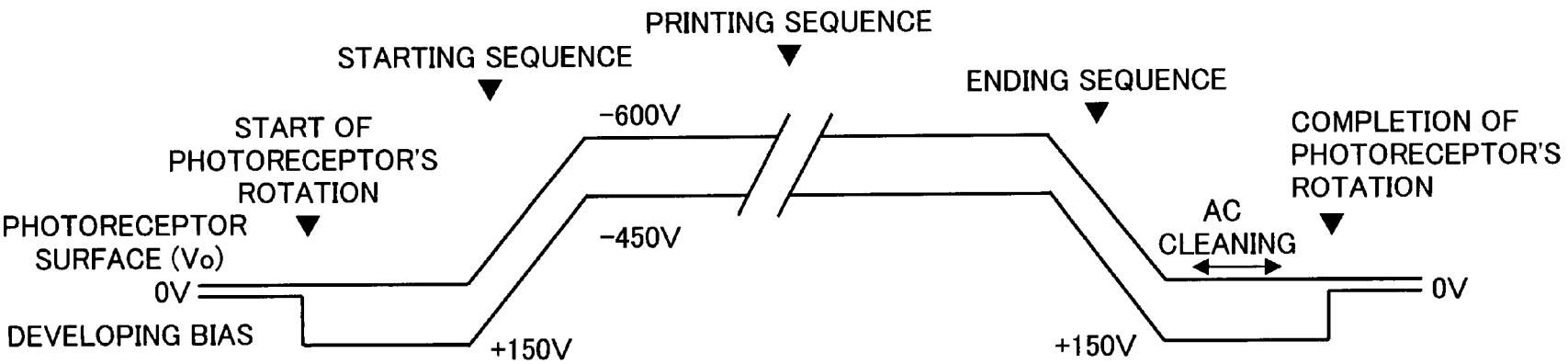
FIG. 5 is a view illustrating an example of a chart showing the progression of (i) a surface potential of a photoreceptor provided in an image forming apparatus according to an embodiment of the present invention and (ii) a developing bias applied to a development device.

FIG. 5 illustrates an example of a chart showing the progression of (i) a surface potential of the photoreceptor and (ii) a developing bias applied to a development roller 17 of the development device 14. A developing bias at the time of AC cleaning (cleaning performed while the cleaning roller 62 is brought into contact with the charging roller 61 and AC voltage is applied to the charging roller 61) is opposite in polarity to the surface potential of the photoreceptor. This makes it possible to prevent the occurrence of fogging and carrier rise caused by the development device 14. The AC voltage at the AC cleaning of the charging roller 61 has little influence on the surface potential of the photoreceptor 11, and leads the surface potential of the photoreceptor 11 to nearly 0V.

At the AC cleaning, the toner that has returned to the photoreceptor 11 is returned to the development device 14 in the following manner. In the present embodiment, a developing bias (+150 V in the present embodiment) which is more positive in polarity than the surface potential of the photoreceptor 11 (nearly 0 V in the present embodiment) is applied to the development roller 17, which allows the development roller 17 to make foreign materials, such as negatively-charged toner remaining on the photoreceptor 11, electrostatically adsorbed thereto. Non-removed residual developer components (residues after the collection) remaining on the surface of the photoreceptor 11 on the upstream side of a development region in the direction of rotation of the photoreceptor 11, more specifically a toner returned from the charging roller 61 is magnetically adsorbed to the surface of the development roller 17, is removed from the surface of the photoreceptor 11. The development region is a region in which the development roller 17 and the photoreceptor 11 are in proximity to each other. The toner adsorbed to the development roller 17 is returned to a developer tank of the development device 14 with the rotation of the development roller 17.

Thus, the development device 14 collects foreign materials, such as residual toner remaining on the photoreceptor 11 after the passage through the charging device 12, at an upstream position from the development region in the rotational direction of the photoreceptor 11 (at the upstream position from a position at which the development roller 17 supplies the developer to the photoreceptor 11 in the direction of rotation of the photoreceptor 11). That is, the development device can perform the cleaning of the photoreceptor 11, together with the development.

Further, the cleaning of the charging roller 61 can be performed not only at the completion of the printing process but also in a case where continuous printing is performed. This will be described below with reference FIG. 4(*b*). When a cumulative printed sheet count reaches a predetermined sheet count, cleaning is started (S12), and the procedure proceeds to an ending sequence (S13). Then, when the surface potential of the rotating photoreceptor 11 becomes nearly zero, the voltage selecting section 71 switches a voltage applied to the charging roller 61 from DC voltage to AC voltage (S14). Thereafter, the contact and release system 63 causes the cleaning roller 62 to come into contact with the charging roller 61 (S15). Note that either the step S14 or the step S15 may come first, or the steps S14 and S15 may be performed at the same time. The order in which the steps S14 and S15 are performed does not matter.

Upon expiry of a predetermined contact time during the AC cleaning (S16), the contact and release system 63 separates the cleaning roller 62 from the charging roller 61 (S17), and the voltage selecting section 71 switches a voltage applied to the charging roller 61 from AC voltage to DC voltage (S18). Note that either the step S17 or the step S18 may come first, or the steps S17 and S18 may be performed at the same time. The order in which the steps S17 and S18 are performed does not matter. Thereafter, the printing process is successively performed. When the printing sequence is completed (YES in S11), the procedure returns to the flow described above with reference to FIG. 4(*a*). If the procedure is under the printing sequence, (NO in S11), the process starting from S12 is repeated.

Thus, in the continuous printing for several hundreds of prints, the printing step is interrupted at the time when a given number of copies are printed, so as to perform the cleaning as above. This brings the same effect as in the case where the cleaning is performed at the end of the printing process.

In the above-mentioned embodiment, the contact and release system 63 brings the cleaning roller 62 into contact with the charging roller 61 at the time of cleaning by application of AC voltage, and then disconnects the cleaning roller 62 from the charging roller 61 at the end of the cleaning. However, the cleaning roller 62 may be in contact with the charging roller 61 all the time without provision of the contact and release system 63.

Incidentally, in order to examine the cleaning effects brought by the application of AC voltage and the cleaning roller 62, aging tests under image formation were carried out at the process speed of 127 mm/s with varying cleaning methods of the charging roller 61. The results of the examination were as follows. When cleaning of the clearing roller 61 was carried out under the conditions where the AC voltage was applied (without a cleaning member), a defective image due to contamination occurred at the completion of 30000 copies. When cleaning of the clearing roller 61 was carried out under the conditions where the cleaning roller 62 was provided (without application of the AC voltage), a defective image due to contamination occurred at the completion of 40000 copies. When cleaning of the clearing roller 61 was carried out under the conditions where the AC voltage was applied to the charging roller 61 and the cleaning roller 62 was in contact with the charging roller 61, neither defective image nor contamination occurred even at the completion of 100000 copies. Thus, it is found that the effect of cleaning enhances in a case where the AC voltage is applied to the charging roller and the cleaning roller 62 is in contact with the charging roller 61.

Figure 8:
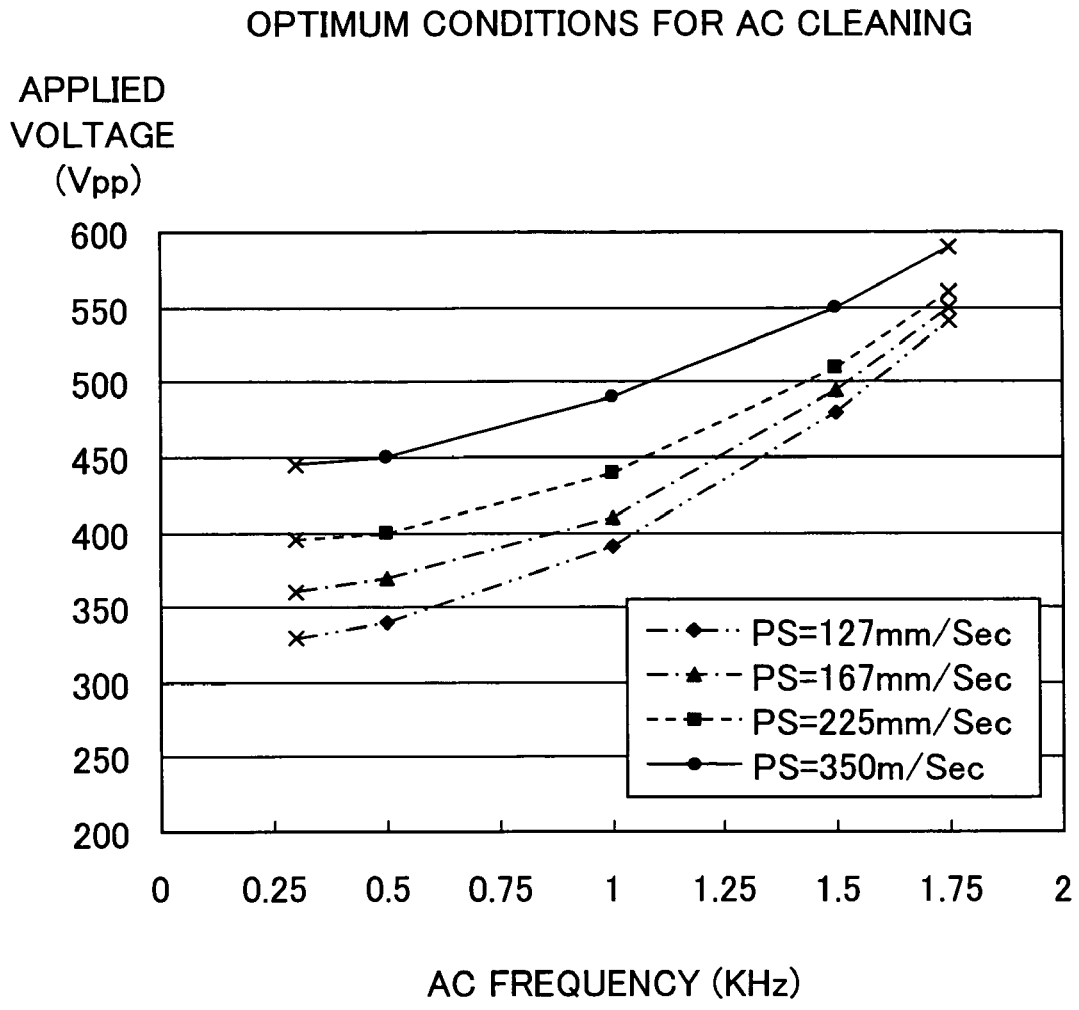
FIG. 8 is a view showing the relationship between AC frequency and an applied voltage of an AC voltage applied to a charging roller, with varying process speeds of the image forming apparatus according to an embodiment of the present invention.

Next, in order to find optimum conditions for the cleaning of the charging roller, relations between AC frequencies and applied voltages were determined. The results of the determination are shown in FIG. 8. The applied voltages were measured with process speeds and the AC frequencies varied. Results of the measurements at a process speed of 127 mm/sec are shown with diamond-shaped marks in a graph of FIG. 8. In this case, when AC frequencies were 0.3 kHz, 0.5 kHz, 1 kHz, 1.5 kHz, and 1.75 kHz, applied voltages (peak values Vpp) were 330 V, 340 V, 390 V, 480 V, and 540 V, respectively. Results of the measurements at a process speed of 167 mm/sec are shown with triangle-shaped mark in the graph of FIG. 8. In this case, when AC frequencies were 0.3 kHz, 0.5 kHz, 1 kHz, 1.5 kHz, and 1.75 kHz, applied voltages (peak values Vpp) were 360 V, 370 V, 410 V, 495 V, and 550 V, respectively. Results of the measurements at a process speed of 225 mm/sec are shown with square-shaped marks in the graph of FIG. 8. In this case, when AC frequencies were 0.3 kHz, 0.5 kHz, 1 kHz, 1.5 kHz, and 1.75 kHz, applied voltages (peak values Vpp) were 395 V, 400 V, 440 V, 510 V, and 560 V, respectively. Results of the measurements at a process speed of 350 mm/sec are shown with circle-shaped marks in the graph of FIG. 8. In this case, when AC frequencies were 0.3 kHz, 0.5 kHz, 1 kHz, 1.5 kHz, and 1.75 kHz, applied voltages (peak values Vpp) were 445 V, 450 V, 490 V, 550 V, and 590 V, respectively.

At too high an AC frequency, a bias voltage does not effectively act on the toner. On the other hand, the residual toner easily readheres to the charging roller at too low an AC frequency. As a result, sufficient cleaning effect cannot be obtained. The cleaning effect was verified by determining whether a printed light-colored image, such as halftone image, has defects in image quality when the cleaning was performed in a copier while an AC voltage was applied to the charging roller with frequency variations.

Too high an applied voltage (Vpp) does not effectively act on the toner. As a result, discharge begins, and the photoreceptor 11 is therefore charged. In order to prevent the photoreceptor 11 from being charged, a discharge start voltage needs to be not more than 550 V. On the other hand, too low an applied voltage (Vpp) has makes it easy for the residual toner to readhere to the charging roller 61, thus bringing an insufficient cleaning effect. Therefore, the peak value Vpp needs to be within 1100 V(±550 V).

As described above, it is clear that optimum conditions for the cleaning are where an AC voltage is applied at a frequency in the range from 0.5 kHz to 1.5 kHz. As shown in FIG. 8, when the frequency is 0.3 kHz and 1.75 kHz at each process speed, the frequency and magnitude (Vpp) of an AC voltage are beyond optimum values (shown with cross marks in FIG. 8).

The voltage control section 82 may change the conditions for the application of the AC voltage (hereinafter also referred to as "application conditions") according to a process speed of the image forming apparatus 1. More specifically, at least one of the frequency and the peak value Vpp of the AC voltage is changed. Thus, the change of the conditions for the application of the AC voltage leads to constantly proper cleaning under the conditions suitable for a process speed. In this regard, printing was performed by using an actual image forming apparatus (full-color copier manufactured by Sharp Corporation; MX4500) to check the cleaning states with varying application conditions at the AC cleaning. 45 copies (process speed of 225 mm/s) were printed in monochrome mode, and 35 copies (process speed of 167 mm/s) were printed in full-color mode. In monochrome printing, an AC voltage at 1000 Hz and Vpp of 440 V was applied at the AC cleaning. In full-color printing, an AC voltage at 1000 Hz and Vpp of 410 V was applied at the AC cleaning. It was found that change of the conditions for the application of the AC voltage ensures an excellent cleaning and prevents the charging roller from getting dirty, thus obtaining electrostatic charging performance.

Note that the cleaning control section 80 of the cleaning device 70 may be realized by hardware logic, or may be realized by software by means of a CPU (Central Processing Unit) as follows. That is, the cleaning device 70 (or image forming apparatus 1) includes a CPU that executes the order of a control program for realizing the aforesaid functions, ROM (Read Only Memory) that stores the control program, RAM (Random Access Memory) that develops the control program in executable form, and a storage device (storage medium), such as memory, that stores the control program and various types of data therein. With this arrangement, the object of the present invention is realized by a predetermined storage medium. The storage medium stores, in computer-readable manner, program codes (executable code program, intermediate code program, and source program) of the control program of the cleaning device 70 (or image forming apparatus 1), which is software for realizing the aforesaid functions. The storage medium is provided to the cleaning device 70 (or image forming apparatus 1). With this arrangement, the cleaning device 70 (or image forming apparatus 1) as a computer (Alternatively, CPU or MPU) reads out and executes program code stored in the storage medium provided.

The storage medium may be tape based, such as a magnetic tape or cassette tape; disc based, such as a magnetic disk including a Floppy® disc and hard disk and optical disk including CD-ROM, MO, MD, DVD, and CD-R; card based, such as an IC card (including a memory card) and an optical card; or a semiconductor memory, such as a mask ROM, EPROM, EEPROM, and a flash ROM.

Further, the cleaning device 70 (or image forming apparatus 1) may be arranged so as to be connectable to a communications network so that the program code is supplied to the cleaning device 70 (or image forming apparatus 19 through the communications network. The communications network is not to be particularly limited. Examples of the communications network include the Internet, intranet, extranet, LAN, ISDN, VAN, CATV communications network, virtual private network, telephone network, mobile communications network, and satellite communications network. Further, a transmission medium that constitutes the communications network is not particularly limited. Examples of the transmission medium include (i) wired lines such as IEEE 1394, USB, power-line carrier, cable TV lines, telephone lines, and ADSL lines and (ii) wireless connections such as IrDA and remote control using infrared light, Bluetooth®, 802.11, HDR, mobile phone network, satellite connections, and terrestrial digital network. Note that the present invention can be also realized by the program codes in the form of a computer data signal embedded in a carrier wave which is embodied by electronic transmission.

As described above, a cleaning device according to the present invention is a cleaning device which cleans a contact charging member that is disposed in contact with an image bearing member and charges the image bearing member with a DC voltage applied to the contact charging member, the cleaning device including: a cleaning member disposed in contact with the contact charging member; and a voltage selecting section which switches a voltage to be applied to the contact charging member from a DC voltage to an AC voltage and then applies the AC voltage thereto during rotation of the image bearing member.

The cleaning device according to the present invention may further include: a contact and release section which switches a position of the cleaning member between a position where the cleaning member is in contact with the contact charging member and a position where the cleaning member is separated from the contact charging member, wherein the contact and release section brings the cleaning member into contact with the contact charging member at application of the AC voltage to the contact charging member.

According to the above arrangement, the contact and release section brings the cleaning member into contact with the contact charging member at the application of the AC voltage to the contact charging member, i.e. at the cleaning with the AC voltage applied thereto. Thus, the contact and release section causes the cleaning member to be separated from the contact charging member when cleaning is not required. This makes it possible to suppress wear of the contact charging member and the cleaning member.

Further, the cleaning device according to the present invention may be such that the contact charging member and the cleaning member are roller-shaped.

According to the above arrangement, the roller-shaped cleaning member is evenly brought into contact with the roller-shaped contact charging member. Therefore, it is possible to clean the contact charging member evenly and accurately.

Still further, the cleaning device according to the present invention may be such that the voltage selecting section applies the AC voltage at a frequency in a range from 500 Hz to 1500 Hz.

According to the above arrangement, the AC voltage in the range from 500 Hz to 1500 Hz is applied at the cleaning of the contact charging member. This frequency is identical with the frequency of a resonance point of the image forming apparatus. Therefore, the frequency of the AC voltage to be applied at the cleaning of the contact charging member is made identical with the frequency of a resonance point of an image forming apparatus in which the cleaning device is provided. This makes it possible to accurately divide foreign substance (s) into foreign substance(s) to be remained on the charging roller and removed by the cleaning member and foreign substance(s) to be returned to the image bearing member. Thus, it is possible to reliably perform cleaning.

Yet further, the cleaning device according to the present invention may further include: a voltage control section which controls so that a peak value of the AC voltage applied by the voltage selecting section is lower than a discharge start voltage between the contact charging member and the image bearing member.

According to the above arrangement, although the AC voltage is applied at the cleaning of the contact charging member, the image bearing member does not start discharging. Therefore, it is possible to prevent the occurrence of fogging and carrier rise caused by the development device of the image forming apparatus in which the cleaning device is provided.

Further, the cleaning device according to the present invention may be such that the voltage control section changes at least one of a frequency and the peak value Vpp of the AC voltage to be applied, according to a process speed of an image forming apparatus in which the cleaning device is provided.

According to the above arrangement, at least one of the frequency and the peak value Vpp of the AC voltage to be applied is changed according to a process speed of the image forming apparatus in which the cleaning device is provided. Therefore, it is possible to constantly perform proper cleaning under the conditions suitable for a process speed.

As described above, an image forming apparatus according to the present invention includes any one of the cleaning devices according to the present invention.

According to the above arrangement, it is possible to form a high-quality image, without adverse effects on the quality of a formed image.

The image forming apparatus according to the present invention may further include: a developing section which develops an electrostatic latent image formed on the image bearing member with a developer; and a developing bias applying section which applies a developing bias to a developing section at the application of the AC voltage to the contact charging member so that the developing bias is opposite in polarity to a voltage applied to a surface of the image bearing member.

According to the above arrangement, a developing bias is applied to the developing section at the cleaning of the contact charging member so that the developing bias is opposite in polarity to a voltage applied to the surface of the image bearing member, the developing section developing an electrostatic latent image formed on the image bearing member with a developer. Therefore, it is possible to prevent the occurrence of fogging and carrier rise caused by the development device. Thus, no adverse effects are exerted on the quality of an image formed.

Further, the image forming apparatus according to the present invention may be such that in the middle of successive printing processes, the voltage selecting section switches the voltage to be applied to the contact charging member from the DC voltage to the AC voltage, and the contact and release section which switches a position of the cleaning member between a position where the cleaning member is in contact with the contact charging member and a position where the cleaning member is separated from the contact charging member brings the cleaning member into contact with the contact charging member, so that the contact charging member is cleaned.

Thus, cleaning of the contact charging member can be performed in the middle of successive printing processes. In this case, even when the number of transfers (print count) is large, the cleaning can be performed in the middle of transfer processes. This makes it possible to continue transfers with the charging roller cleaned all the time. Therefore, it is possible to form a high-quality image all the time, without adverse effects on the quality of a formed image.

As described above, a method for controlling a cleaning device according to the present invention is a method for controlling a cleaning device in which a cleaning member cleans a contact charging member that is disposed in contact with an image bearing member and charges the image bearing member with a DC voltage applied to the contact charging member, including: voltage selecting step of switching a voltage to be applied to the contact charging member from a DC voltage to an AC voltage during rotation of the image bearing member.

The above method brings about the same effects as the cleaning device, and prevents toner from adhering to the contact charging member and enhances performance on cleaning of the contact charging member.

The method for controlling the cleaning device may be realized by a computer. In such a case, the present invention also encompasses: a control program for realizing by using a computer a method for controlling a cleaning device in which a cleaning member cleans a contact charging member that is disposed in contact with an image bearing member and charges the image bearing member with a DC voltage applied to the contact charging member, wherein a computer is caused to execute voltage selecting control to switch a voltage to be applied to the contact charging member from a DC voltage to an AC voltage during rotation of the image bearing member; and a computer-readable storage medium storing the control program.

The control program and the computer-readable storage medium bring the same effects as the foregoing cleaning device.

Note that the present invention is applicable to, for example, an electrophotographic image forming apparatus such as a printer, a copier, a facsimile machine, and an MFP (Multi Function Printer).

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A cleaning device which cleans a contact charging member that is disposed in contact with an image bearing member and charges the image bearing member with a DC voltage applied to the contact charging member, the cleaning device comprising:

a cleaning member disposed in contact with the contact charging member;

a voltage selecting section which switches a voltage to be applied to the contact charging member from a DC voltage to an AC voltage and then applies the AC voltage thereto during rotation of the image bearing member, and a voltage control section which controls so that a peak value of an AC voltage applied by the voltage selecting section is lower than a discharge start voltage between the contact charging member and the image bearing member.

2. The cleaning device according to claim 1, further comprising:

a contact and release section which switches a position of the cleaning member between a position where the cleaning member is in contact with the contact charging member and a position where the cleaning member is separated from the contact charging member, wherein the contact and release section brings the cleaning member into contact with the contact charging member at application of the AC voltage to the contact charging member.

3. The cleaning device according to claim 1, wherein the contact charging member and the cleaning member are roller-shaped.

4. The cleaning device according to claim 1, wherein the voltage selecting section applies the AC voltage at a frequency in a range from 500 Hz to 1500 Hz.

5. The cleaning device according to claim 1, wherein the voltage control section changes at least one of a frequency and the peak value Vpp of the AC voltage to be applied, according to a process speed of an image forming apparatus in which the cleaning device is provided.

6. The cleaning device according to claim 3, wherein the cleaning member is brought into contact with the contact charging member for a period of time for one turn of the contact charging member or longer.

7. The cleaning device according to claim 1, wherein the cleaning member is a brush.

8. The cleaning device according to claim 1, wherein the cleaning member has a shape such that the cleaning member does not rotate when the cleaning member contacts the contact charging member.

9. An image forming apparatus comprising a cleaning device which cleans a contact charging member, disposed in contact with an image bearing member, which charges the image bearing member with a DC voltage applied to the contact charging member, the cleaning device comprising:

a cleaning member disposed in contact with the contact charging member;

a voltage selecting section which switches a voltage to be applied to the contact charging member from a DC voltage to an AC voltage and then applies the AC voltage thereto during rotation of the image bearing member, and a voltage control section which controls so that a peak value of an AC voltage applied by the voltage selecting section is lower than a discharge start voltage between the contact charging member and the image bearing member.

10. The image forming apparatus according to claim 9, further comprising:

a developing section which develops an electrostatic latent image formed on the image bearing member with a developer, wherein a voltage bias is applied to the developing section at the application of the AC voltage to the contact charging member so that the voltage bias is opposite in polarity to a voltage applied to a surface of the image bearing member.

11. The image forming apparatus according to claim 9, wherein in the middle of successive printing processes, the voltage selecting section switches the voltage to be applied to the contact charging member from the DC voltage to the AC voltage, and a contact and release section which switches a position of the cleaning member between a position where the cleaning member is in contact with the contact charging member and a position where the cleaning member is separated from the contact charging member brings the cleaning member into contact with the contact charging member, so that the contact charging member is cleaned.

12. The image forming apparatus according to claim 9, wherein image formation is performed by using a toner containing an additive.

13. A method for controlling a cleaning device in which a cleaning member cleans a contact charging member that is disposed in contact with an image bearing member and charges the image bearing member with a DC voltage applied to the contact charging member, comprising:

voltage selecting step of switching a voltage to be applied to the contact charging member from a DC voltage to an AC voltage during rotation of the image bearing member, and a voltage controlling step of controlling the switching of the voltage to be applied in the voltage selecting step so that a peak value of an AC voltage is lower than a discharge start voltage between the contact charging member and the image bearing member.

14. A non-transitory computer-readable storage medium storing a control program for realizing by using a computer a method for controlling a cleaning device in which a cleaning member cleans a contact charging member that is disposed in contact with an image bearing member and charges the image bearing member with a DC voltage applied to the contact charging member, wherein a computer is caused to execute voltage selecting control to switch a voltage to be applied to the contact charging member from a DC voltage to an AC voltage during rotation of the image bearing member, and a computer is caused to execute voltage control so that a peak value of an AC voltage is lower than a discharge start voltage between the contact charging member and the image bearing member.

* * * * *